US011415304B1

(12) United States Patent
Zhang et al.

(10) Patent No.: US 11,415,304 B1
(45) Date of Patent: Aug. 16, 2022

(54) LED LINEAR LIGHT DEVICE WITH SPEAKER OPPOSITE LIGHT OUTPUT SURFACE

(71) Applicant: GUANGZHOU SITEJI STAGE LIGHTING EQUIPMENT CO., LTD, Guangzhou (CN)

(72) Inventors: Yingping Zhang, Guangzhou (CN); Minghua Yang, Guangzhou (CN)

(73) Assignee: GUANGZHOU SITEJI STAGE LIGHTING EQUIPMENT CO., LTD, Guangzhou (CN)

( * ) Notice: Subject to any disclaimer, the term of this patent is extended or adjusted under 35 U.S.C. 154(b) by 0 days.

(21) Appl. No.: 17/472,712

(22) Filed: Sep. 13, 2021

(30) Foreign Application Priority Data

Aug. 16, 2021 (CN) ..... 202121923216.7

(51) Int. Cl.

| | |
|---|---|
| ***F21V 33/00*** | (2006.01) |
| ***F21V 23/00*** | (2015.01) |
| ***H05B 45/24*** | (2020.01) |
| *F21Y 115/10* | (2016.01) |

(52) U.S. Cl.
CPC ..... *F21V 23/004* (2013.01); *F21V 33/0056* (2013.01); *H05B 45/24* (2020.01); *F21Y 2115/10* (2016.08)

(58) Field of Classification Search
CPC .... F21V 7/0066; F21V 7/0083; F21V 23/005; F21V 33/0056; F21V 11/02
See application file for complete search history.

(56) References Cited

U.S. PATENT DOCUMENTS

| | | | | | |
|---|---|---|---|---|---|
| 3,540,343 | A | * | 11/1970 | Rifkin | A63J 17/00 84/464 R |
| 3,635,121 | A | * | 1/1972 | Knauff | A63J 17/00 84/464 R |
| 4,176,581 | A | * | 12/1979 | Stuyvenberg | A63J 17/00 84/464 R |
| 4,254,453 | A | * | 3/1981 | Mouyard | G09F 13/22 340/815.54 |
| 4,306,716 | A | * | 12/1981 | James | A63F 9/24 273/460 |
| 4,668,895 | A | * | 5/1987 | Schneiter | F21S 10/02 315/156 |
| 4,733,335 | A | * | 3/1988 | Serizawa | B60Q 1/56 362/503 |
| 4,809,584 | A | * | 3/1989 | Forrest | A63J 17/00 340/815.46 |
| 4,935,665 | A | * | 6/1990 | Murata | H01L 25/0753 313/500 |

(Continued)

*Primary Examiner* — Ismael Negron

(57) ABSTRACT

An LED device includes a circuit board with a control module, LEDs arranged on the circuit board, a cover member provided over the LEDs, a reflective member provided between the circuit board and the cover member, a speaker provided on a side of the circuit board opposite the LEDs, and sensor electrically connected to the control circuit and configured to generate a signal based on sound generated by the speaker to control lighting modes of the LEDs. The control module is electrically connected with the LEDs to control lighting modes of the LEDs, and an reflective member is provided between the circuit board and the cover member. The reflective member is provided with a plurality of through cavities corresponding to each of the LEDs.

10 Claims, 2 Drawing Sheets

(56) References Cited

U.S. PATENT DOCUMENTS

| | | | | | |
|---|---|---|---|---|---|
| 5,580,156 | A * | 12/1996 | Suzuki | B60Q 7/00 | 116/63 P |
| 5,772,307 | A * | 6/1998 | Philyaw | F21V 33/0056 | 362/253 |
| 5,819,454 | A * | 10/1998 | Rosenitsch | G09F 9/33 | 40/452 |
| 5,980,057 | A * | 11/1999 | Christie | F21V 33/0056 | 362/234 |
| 6,164,792 | A * | 12/2000 | Nakagome | B60Q 3/88 | 362/276 |
| 6,779,905 | B1 * | 8/2004 | Mazursky | A61L 9/035 | 362/101 |
| 8,172,434 | B1 * | 5/2012 | Olsson | B63B 45/00 | 362/346 |
| 9,739,462 | B2 * | 8/2017 | Georgitsis | F21V 5/04 | |
| 10,222,012 | B2 * | 3/2019 | Kim | F21V 11/02 | |
| 10,309,618 | B2 * | 6/2019 | Enno | F21S 2/005 | |
| 10,728,640 | B2 * | 7/2020 | Lee | G10L 17/00 | |
| 2005/0036327 | A1 * | 2/2005 | Patel | B60Q 3/85 | 362/487 |
| 2007/0070618 | A1 * | 3/2007 | Talamo | E01F 9/20 | 362/153.1 |
| 2014/0092596 | A1 * | 4/2014 | Deutsch | H05K 1/142 | 362/236 |
| 2015/0153037 | A1 * | 6/2015 | Lee | F21K 9/23 | 381/334 |
| 2018/0087766 | A1 * | 3/2018 | Zhang | F21V 17/12 | |
| 2021/0364161 | A1 * | 11/2021 | Acker | F21V 3/00 | |

* cited by examiner

LED LINEAR LIGHT DEVICE WITH SPEAKER OPPOSITE LIGHT OUTPUT SURFACE

TECHNICAL FIELD

The present disclosure relates to the technical field of a surface light source, in particular to an LED surface light source and a sound device with the LED surface light source.

BACKGROUND

LED has advantages of small size, long life and high efficiency, and can be used continuously for 100,000 hours. LED has gradually replaced incandescent lamp into a mainstream in the field of lighting. However, LED light sources in the market are of certain size and mode, which are not flexible enough in application and have higher unit price costs.

In addition, with an improvement of living standard, an application of a sound device in home life is increasingly common. Users can play music through sound devices to reduce their pressure or provide entertainment. Some of the sound devices in the market are additionally provided with light sources to improve user's experience, but the light sources of the existing sound devices are only used for illumination and cannot satisfy people's pursuit and enjoyment of music atmospheres according to rhythm changes of a music played like atmosphere lamps of a KTV, so that it is necessary to make further improvement.

SUMMARY

In view of this, the present disclosure provides an LED surface light source which can effectively overcome the above technical problems and a sound device with the LED surface light source.

In one aspect, the present disclosure provides an LED surface light source, including a circuit board, LEDs arranged on the circuit board, and a light emitting plate covered on the LEDs, wherein the circuit board is provided with a control module, the control module is electrically connected with the LEDs to control lighting modes of the LEDs, and an interval member is provided between the circuit board and the light emitting board, and the interval member is provided with a through receiving cavity corresponding to each of the LEDs.

In another aspect, the present disclosure provides a sound device including a sound emitting unit and the above LED surface light source, wherein the sound emitting unit and the LEDs are respectively arranged on opposite sides of the circuit board.

Compared with the prior art, by the arrangement of the receiving cavity, the present disclosure not only avoids mutual interferences of light rays of adjacent LEDs, but also forms a converging effect on the light emitted by each of the LEDs, so that each of the LEDs forms a separate surface light source unit with the corresponding receiving cavity, and a user can obtain surface light sources of different specifications through different numbers of LEDs as required; moreover, the circuit board is provided with a control module to control the lighting modes of the LEDs, which can be used as either a lighting lamp or an atmosphere lamp in a device such as a sound device, in order to adapt to various occasions.

DESCRIPTION OF THE EMBODIMENTS

Figure 1:
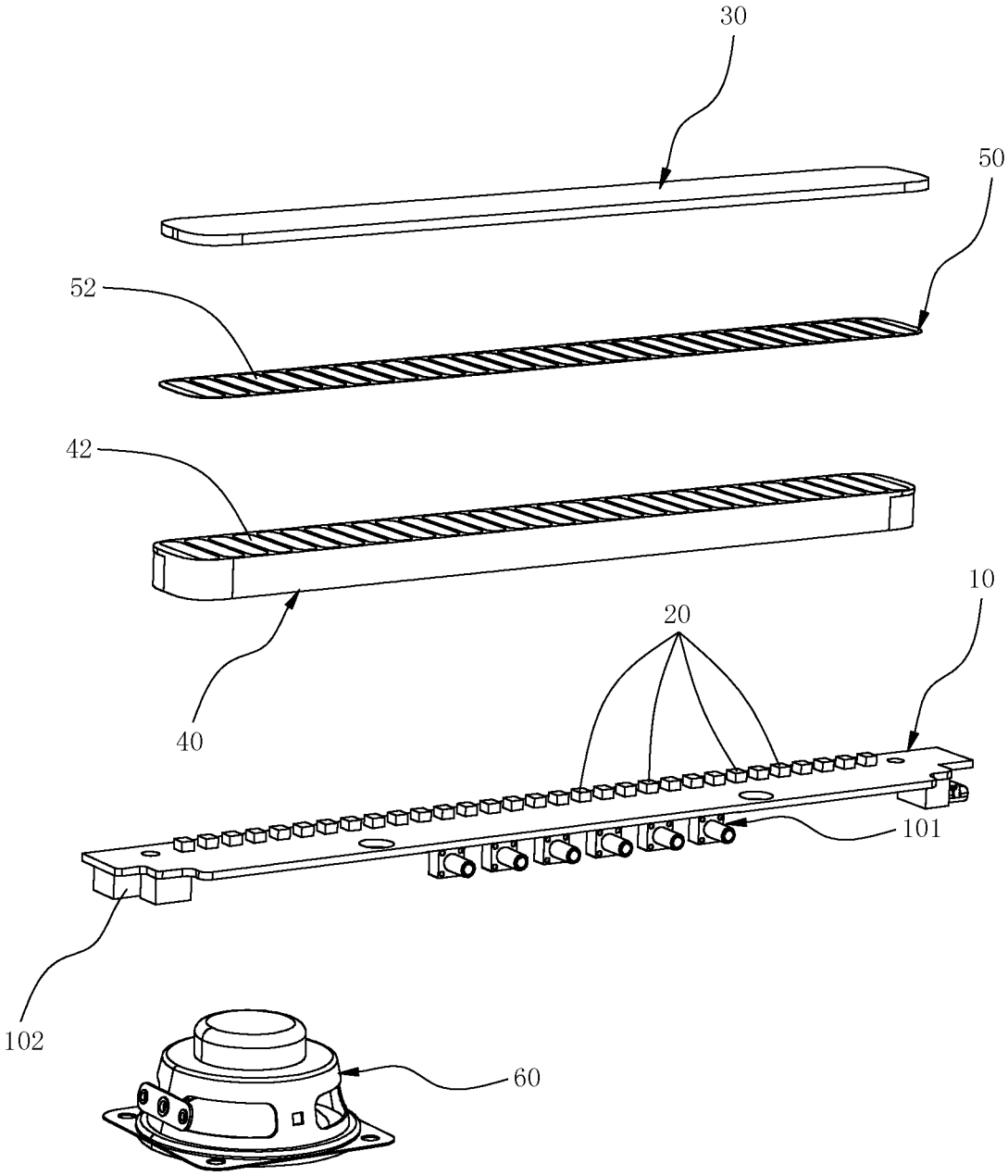
FIG. 1 is an exploded schematic diagram of an embodiment of a sound device of the present disclosure.

In order to clarify the present disclosure, the present disclosure will be described in detail in conjunction with accompanying drawings hereinafter. The drawings exemplify one or more embodiments of the present disclosure in order to make the technical solutions disclosed by the present disclosure more accurate and thorough. However, it should be understood that the present disclosure can be implemented in a variety of different forms, and is not limited to the embodiments described below.

The same or similar reference numerals in the present disclosure correspond to the same or similar components; in the description of the present disclosure, it should be noted that an orientation or positional relationship indicated by terms "up", "down", "left", "right" and the like is based on an orientation or positional relationship shown in the drawings, which is merely for ease of description of the disclosure and for simplification of the description, and is not intended to indicate or imply that the device or element referred to must have a particular orientation, be constructed and operated in a particular orientation. Therefore, the terms about positional relationship described in the drawings are only used as exemplary description, which cannot be construed as limiting of the present disclosure. The specific meanings of the above-mentioned terms in the present disclosure can be specifically understood by a person skilled in the art.

As shown in FIG. 1, the present disclosure provides an LED surface light source. The LED surface light source includes a circuit board 10, a plurality of LEDs 20 arranged on the circuit board 10, a light emitting plate 30 covered on the LEDs 20, and an interval member 40 provided between the light emitting plate 30 and the circuit board 10.

The circuit board 10 may be a general printed circuit board 10 (PCB) or a flexible printed circuit board 10 (FPCB). The circuit board 10 is provided with a control module. The control module may be an integrated circuit within the circuit board or a control chip connected to the circuit board. The LEDs 20 are fixed on the circuit board 10 by wire bonding, soldering, and the like, and is electrically connected to the control module of the circuit board 10, and lighting modes of the LEDs 20 can be controlled by the control module. Preferably, the LEDs 20 are a plurality of LEDs, which are arranged in an array on the circuit board 10. In the illustrated embodiment, the LEDs 20 are arranged in a row, and two adjacent LEDs 20 are spaced apart by a certain distance. In other embodiments, the LEDs 20 may be arranged in a plurality of rows and/or columns, without being limited to the illustrated embodiment. In the LED surface light source of the present disclosure, a corresponding number of LEDs 20 can be arranged on the circuit board 10 as required, so that brightness, size, and the like of a whole light source can be adjusted according to an installation requirement, and the application is more flexible and convenient, and the cost is also lower.

In some embodiments, each of the LEDs 20 can emit the same light color, and be for example a white LED. At this time, the LED surface light source of the present disclosure is mainly used for illumination, and the control module can control the lighting of a part of the LEDs 20 or all of the LEDs 20 according to a brightness requirement of the illumination, which is more energy-saving in use. In some embodiments, the LEDs 20 can emit different light colors, for example, a portion of the LEDs are white LEDs, a portion of the LEDs are color LEDs (such as red LEDs, blue LEDs, green LEDs, etc.). The control module may control the lighting of different LEDs 20 to meet different usage requirements, for example, when the control module causes the white LEDs 20 to be lit, the LED surface light source of the present disclosure can be used as illumination; when the control module causes the color light LEDs 20 to be lit, the LED surface light source of the present disclosure can be used as atmosphere light, so that the LED surface light source of the present disclosure can achieve multiple functions through one light source, and adapt to a variety of different occasions.

Figure 2:
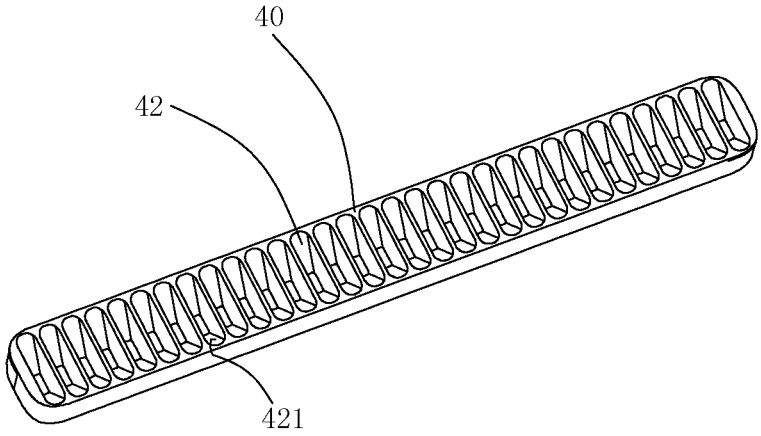
FIG. 2 is another perspective view of an interval member of the sound device shown in FIG. 1.
Figure 3:
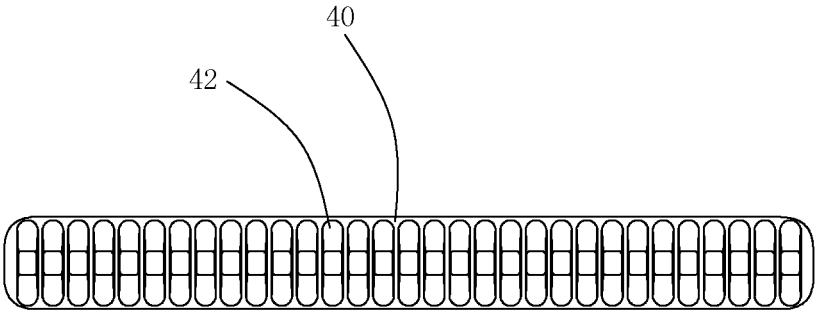
FIG. 3 is a plan view of the interval member shown in FIG. 2.

The interval member 40 is disposed on the circuit board 10, and the two are fixedly connected by screws or the like. The interval member 40 defines a receiving cavity 42 corresponding to each of the LEDs 20. The receiving cavity 42 extends through the interval member 40 in a thickness direction thereof, and a wall surface of each receiving cavity 42 surrounds a corresponding LED 20 after an assembly. Preferably, the wall surface of the receiving cavity 42 is a convex curved surface, which can guide and converge the light emitted from the LEDs 20. Referring to FIG. 2 and FIG. 3, each receiving cavity 42 is substantially in a shape of an ingot, wherein a side of the receiving cavity 42 facing the circuit board 10 is in a shape of a square, and a side of the receiving cavity 42 facing the light emitting plate 30 is in a shape of a racetrack, and the receiving cavity 42 gradually increases in length and width in a direction away from the LED 20. Through the arrangement of the receiving cavity 42, the light rays of adjacent LEDs 20 are prevented from interfering with each other, and the light emitted from each of the LEDs 20 is converged. Each of the LEDs 20 cooperates with the corresponding receiving cavity 42 to form an independent surface light source unit. In other embodiments, the shape of the receiving cavity 42 may also be a circular, square, pentagram, heart-shaped pattern, etc., and the LED surface light source formed is a surface light source of a corresponding pattern. The shape of each receiving cavity 42 may be the same as in the illustrated embodiment or may be different, such as partially heart-shaped, partially circular, or the like.

The light emitting plate 30 is a light-transmitting thin plate structure, and plays a role of shielding and protecting the LEDs 20. Preferably, the light transmittance of the light emitting plate 30 is not more than 70%, so that the light emitted is softer and glare is reduced. Preferably, a soft light member, such as a soft light sticker 50, is also provided between the light emitting plate 30 and the interval member 40, and a light transmittance of the soft light sticker 50 is not more than 75%, and the light emitted from the LEDs 20 is emitted from the light emitting plate 30. In the illustrated embodiment, the soft light sticker 50 is provided with a cavity 52 corresponding to each receiving cavity 42. A shape and size of the cavity 52 are consistent with a shape and size of a side of the receiving cavity 42 facing the light emitting plate 30. The soft light sticker 50 transmits light at a position of the cavity 52, and does not transmit light at other positions, for example, an area outside the cavity 52 is printed with black to form an opaque effect. In this embodiment, the light emitting plate 30 and the soft light sticker 50 are connected to the interval member 40 by gluing, and the light emitting plate 30 seals the LEDs 20 in the interval member 40 after the gluing, in order to avoid external dust and moisture, etc. to affect the use of the LEDs 20.

The present disclosure also provides a sound device, which comprises the LED surface light source and at least one sound emitting unit, such as a loudspeaker 60, etc. In the illustrated embodiment, the loudspeaker 60 is connected to the circuit board 10 of the LED surface light source and electrically connected to the control module of the circuit board 10. In the illustrated embodiment, the LEDs 20 and the loudspeaker 60 are respectively arranged on opposite sides of the circuit board 10 to facilitate an assembly of the LED surface light source. Preferably, the circuit board 10 is provided with a sensor, such as a miniature spectrum sensor, for acquiring spectrums of music played by the loudspeaker 60. The sensor is electrically connected to the control module of the circuit board, the sensor senses a sound played by the loudspeaker 60 and generates a corresponding signal, and the control module controls the lighting modes of the LEDs 20 according to the signal of the sensor, so that the color and brightness of the LEDs 20 are changed according to the rhythm of the played sound, such as the music, and thus the atmosphere brought by the music is enhanced, a good audio-visual effect is formed, and the user's experience is improved.

It should be noted that the present disclosure is not limited to the above-mentioned embodiments, and according to the inventive spirit of the present disclosure, other changes can be made by those skilled in the art. These changes made according to the inventive spirit of the present disclosure should be included in the scope of protection claimed by the present disclosure.

What is claimed is:

1. An LED surface light source comprising:

a circuit board, including a control module;

a plurality of LEDs arranged on the circuit board;

a cover plate provided over the LEDs; and a reflective member provided between the circuit board and the cover plate, and provided with a plurality of through cavities corresponding to each of the LEDs, wherein the control module is configured as an integrated circuit in the circuit board and is electrically connected to the LEDs, wherein a cross-sectional size of each through cavity increases from the circuit board toward the cover plate, a side of each through cavity facing the circuit board is in a shape of a square, a side of each through cavity facing the cover plate is in a shape of a closed-loop which comprises two semicircles connected by two parallel lines and facing each other, and a wall surface of each through cavity is a convex curved surface and capable of converging light emitted from the LEDs.

2. The LED surface light source according to claim 1, wherein the plurality of LEDs include LEDs of different colors.

3. The LED surface light source according to claim 1, wherein the LED surface light source further comprises diffuser member provided between the cover plate and the reflective member, and the diffuser member transmits light corresponding to a position of each through cavity.

4. The LED surface light source according to claim 3, wherein the diffuser member, the cover plate and the reflective member are connected by a glue, and a light transmittance of the diffuser member is not more than 75%, and a light transmittance of the cover plate is not more than 70%.

5. A sound device comprising the LED surface light source according to claim 1, and further comprising a loudspeaker arranged on a side of the circuit board opposite the LEDs.

6. The sound device according to claim 5, wherein the plurality of LEDs include LEDs of different colors.

7. The sound device according to claim 5, further comprises a miniature spectrum sensor electrically connected to the control module of the circuit board.

8. The sound device according to claim 7, wherein the miniature spectrum sensor is configure for sensing spectrums of music played by the loudspeaker.

9. The sound device according to claim 5, wherein the LED surface light source further comprises a diffuser member provided between the cover plate and the reflective member, and the diffuser member transmits light corresponding to a position of each through cavity.

10. The sound device according to claim 9, wherein the diffuser member, the cover plate and the reflective member are connected a glue, and a light transmittance of the diffuser member is not more than 75%, and a light transmittance of the cover plate is not more than 70%.

* * * * *